US005211975A

United States Patent [19]

Mendenhall et al.

[11] Patent Number: 5,211,975

[45] Date of Patent: May 18, 1993

[54] MICROWAVABLE FOOD CONTAINING PACKAGE INCLUDING A SUSCEPTOR SLEEVE

[75] Inventors: Abraham H. Mendenhall, Morris, N.J.; Joseph F. Irace; Joseph Skudrzyk, both of St. Louis, Mo.

[73] Assignee: Packaging Concepts, Inc., St. Louis, Mo.

[21] Appl. No.: 703,280

[22] Filed: May 20, 1991

[51] Int. Cl.[5] ..... B65D 81/34

[52] U.S. Cl. ..... 426/107; 426/234; 219/10.55 E

[58] Field of Search ..... 426/107, 234, 243; 219/10.55 E

[56] References Cited

U.S. PATENT DOCUMENTS 4,230,924 10/1980 Brastad et al. .
4,258,086 3/1981 Beall .
4,267,420 5/1981 Brastad .
4,553,010 11/1985 Bohrer et al. .
4,555,605 11/1985 Brown et al. .
4,567,341 1/1986 Brown .
4,590,349 5/1986 Brown et al. .
4,592,914 6/1986 Kuchenbecker .
4,594,492 6/1986 Maroszek .
4,612,431 9/1986 Brown et al. .
4,626,641 12/1986 Brown .
4,641,005 2/1987 Seiferth .
4,661,671 4/1987 Maroszek .
4,678,882 7/1987 Bohrer et al. .
4,735,513 4/1988 Watkins et al. ..... 426/107
4,742,203 5/1988 Brown et al. .
4,775,771 10/1988 Pawlowski et al. .
4,780,587 10/1988 Brown .
4,794,005 12/1988 Swiontek .
4,825,025 4/1989 Seiferth .
4,861,958 8/1989 Bohrer et al. .

*Primary Examiner*—Steven Weinstein
*Attorney, Agent, or Firm*—Paul M. Denk

[57] ABSTRACT

A microwavable food product package comprises two separate parts: a container in which the food is packaged, and a sleeve which fits around the container. The sleeve includes selected areas upon which microwave interactive material (a metal layer) is printed. The sleeve is fitted over the food package such that the interactive material is in line with the food contained in the package. The metal layer, in line with the food, assists in the heating of the food.

3 Claims, 1 Drawing Sheet

MICROWAVABLE FOOD CONTAINING PACKAGE INCLUDING A SUSCEPTOR SLEEVE

BACKGROUND OF THE INVENTION

This invention relates to the microwave heating of food, and in particular, to a manner of applying microwave interactive material (metals) to the package to assist in the heating of a food product contained within the package.

Typically, in a microwavable food package containing a microwave susceptor to assist in the heating of food within the package, the metal layer is applied to the package which contains the food. The metal layer is thus in close proximity to the food. In such a package, the metal layer can bubble, blister, or otherwise break down and contaminate the food within the package during heating. To minimize this problem, the metal layer is often placed between two sheets of paper or the like which are held together with an adhesive compound. However, these adhesives, when heated to high temperatures in the microwave (temperatures as high as 400 F. can be reached when using metal layers) can cause harmful emissions.

SUMMARY OF THE INVENTION

One object of this invention is to provide a microwavable food package having a heat assist which reduces the possibility of contamination of the food due to the breakdown of the metal susceptor or emissions from the adhesive.

A principle object of this invention is to provide a sleeve accessory for use in conjunction with a microwavable package, for use in assisting the heating of any material contained therein, such as food product or the like, and which sleeve may be disposable, or even reusable.

Another object of this invention is to provide such a microwaveable package which is inexpensive and disposable.

Other objects of this invention will be apparent to those skilled in the art in light of the following description and accompanying drawings.

In accordance with this invention, generally stated, a microweavable food containing package is provided. The package includes a food container made of a material transparent to microwaves and a sleeve which surrounds the container. The sleeve is separate from the food container and has a microwave susceptor applied thereto to facilitate heating of the food product held in the container. The sleeve may be disposable, or even reusable. The food container and the sleeve can be made of either one-ply or two-ply material. If the container is made from two-ply material, a minimum amount of adhesive is used to hold the two plies together. The amount of adhesive used can be 80% or less then the amount used to hold together a two-ply container having a microwave susceptor buried between the two plies. When the container and sleeve are packaged, the sleeve can be pre-wrapped around said container or it can be separate from the container to be applied to the container by a customer. If the sleeve is to be applied to the container by the customer, it can be formed as a tube or a sheet which is wrapped around the container. In the latter case, the sheet will have adhesive on one end to be put in contact with another end by the consumer to hold the sleeve around said container.

DESCRIPTION OF THE PREFERRED EMBODIMENT

Figure 1:
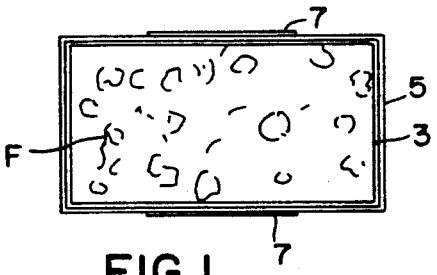
FIG. 1 is cross-sectional view of a microwavable package of the present invention.

Referring to the Figures, reference numeral 1 indicates one illustrative embodiment of the microweavable package of the present invention. The package includes a container 3 of food F to be cooked in a microwave. Container 3 is a conventional form-and-fill or preformed container. The container 3 is made from conventional one-ply substrate or a conventional two-ply substrate, both of which are transparent to microwaves. The substrates may be made from either paper or film. If a two-ply substrate is used, the plies are held together with a minimum amount of adhesive. The use of adhesive in this package could be as much as 80% less than is used in packages in which a susceptor is buried between the two plies. Much less adhesive can be used because there is not the need to maintain the integrity of the package because no susceptor is placed in container 3.

Figure 3:
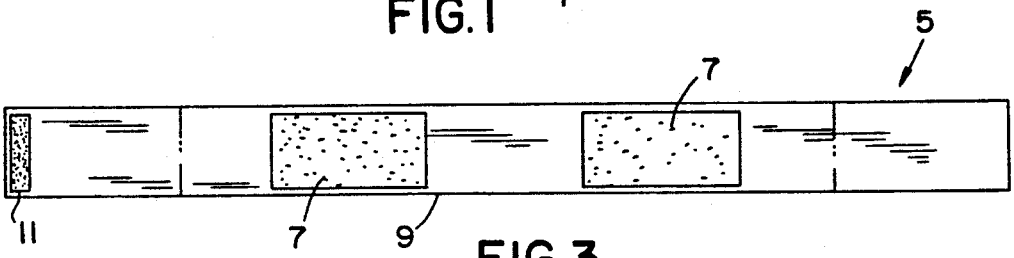
FIG. 3 is a plan view of a length of sheet containing susceptive material for wrapping about a container.

A gusseted or expanded sleeve accessory 5 fits around container 3. A microwave susceptor 7 is applied to the sleeve 5 in selected areas Sleeve 5 is preferably made from a one-ply paper or film, of one or more mils thickness, as customarily used in the art. However, if a heavy metal layer is used, the sleeve may be made from a two-ply substrate. The sleeve may be formed as a tube which slides over the container. Alternatively, the sleeve may be formed as a sheet 9 (FIG. 3) which is wrapped around the container 3. The sheet 9 has a strip of adhesive 11 applied at one end thereof. When the sheet 9 is wrapped around the container 3, the adhesive 11 is placed in contact with the opposite side of sheet 9 so that sheet 9 will be frictionally held onto the container 3. Regardless the metal may be applied, as by vacuum deposition to a surface of the sleeve, or strip, preferably to an exterior surface, for further remoteness from the food or other product being heated, or it can be applied to the interior of the sleeve.

When packaged, the food is packed in container 1. The sleeve 5 containing heat assist element 7 is either pre-wrapped around the container 1 or is packed separately such that the consumer places the sleeve around container 1 prior to heating. If the consumer is to apply sleeve 5 to container 3, sleeve 5 is made sufficiently large so that the consumer can easily apply the sleeve to container 3. However, sleeve 5 is not made so large that the beneficial effects of heat assist element 7 are reduced or eliminated.

This design completely separates the susceptor 7 from the food package. Susceptor 7 is not adhered to container 3 by adhesive, and therefore, the possibility that it can migrate into the food within the container is minimized, if not eliminated. This design also substantially reduces the amount of adhesive used to produce the package and thus substantially eliminates any harmful emissions which may be created by the heating of the adhesive.

This design has the further advantage of being able to return the microwave food container 3 to conventional food packages without regard to the injection of any metals into the package. The use of a separate sleeve facilitates construction of a wide variety of patterns of heat assist material and placement of the material through demetallizing technology to obtain direct and more controlled microwave heating of the food.

Figure 2:
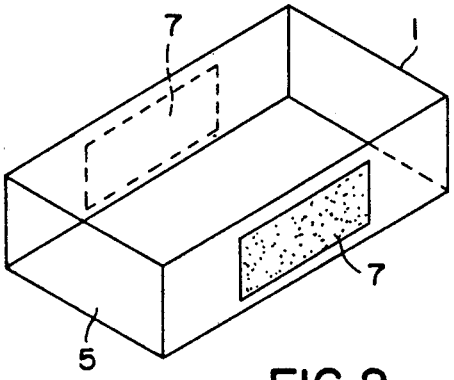
FIG. 2 is an isometric view of one embodiment of a sleeve.

The tubular sleeve, comprising the sleeve member 5, having the heat assist elements 7 provided to its sides, is more aptly shown in FIG. 2. This particular sleeve can be provided, within the same overall packaging that may contain the container 3, holding the food product, as noted, and simply can be slipped around the container in preparation for its microwaving.

Figure 4:
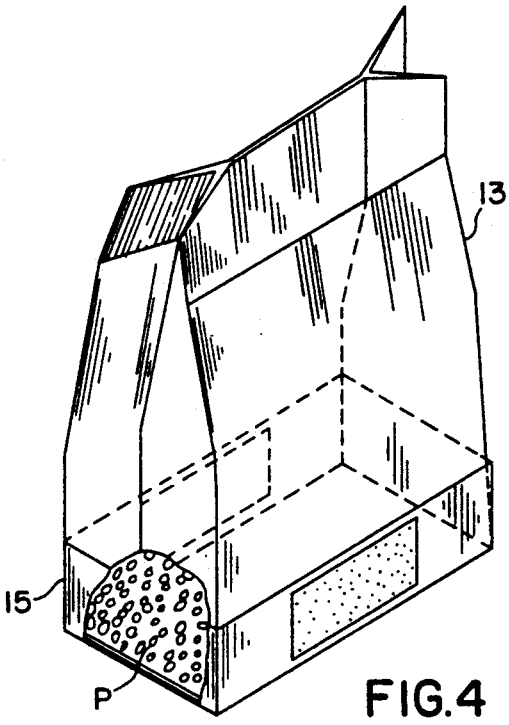
FIG. 4 is an isometric view of a package for use for holding a product, such as the food product popcorn as noted, having the sleeve accessory of this invention loosely applied thereto.

As can be seen in FIG. 4, a food package is shown in its usable form, as noted at 13, and which includes the usual bag which may be formed in the configuration of a tubular or gusseted bag, of the type as previously explained. Furthermore, it may be formed of a single or multiple ply of paper, or polymer, or combinations thereof, as known in the art. The sleeve 15 of this invention is applied, by the consumer, about the lower perimeter of the container 13, when it is readied for usage, and therein affords the heat assist to augment the cooking of the food product therein, which in this particular instance, may comprise a supply of popcorn kernels, as noted at P. The sleeve 15 is made in the manner as previously reviewed in this application, and may be applied by the user around the container 13, in preparation for its heating. Obviously, as previously explained, and particularly where popcorn for popping is marketed for use in application in the microwave oven, a series of the containers 13, prepackaged with the popcorn kernels, may be marketed in a combination package, containing up to three or more containers 13, and a series of the sleeves 15 are likewise packaged within the assembly, ready for application by the homemaker, when preparing to pop one of the containers of popcorn, within the microwave, for consumption. This provides an illustrated example of the ease of usage and application of the sleeve of this invention, when applied as an accessory, for use with a microwavable package, such as the popcorn container as shown in this figure.

Figure 5:
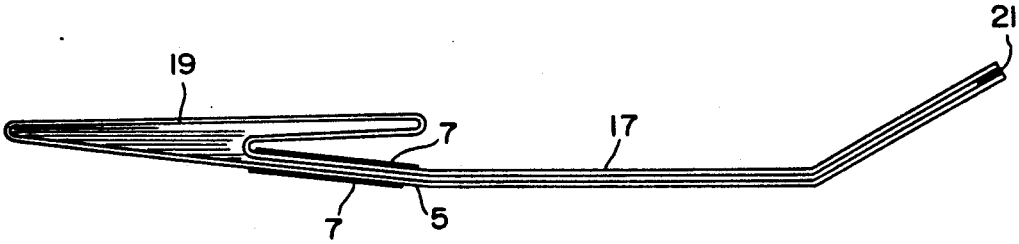
FIG. 5 is a view of a collapsed container having the sleeve with susceptive material embraced therearound, at a particular location, in preparation for microwaving.

In referring to FIG. 5, a gussetted container, as can be seen at 17, is provided, and is of the type of configuration as normally used in the popping of popcorn. Usually, the popcorn is supplied in a quantity at the base, as at 19, of the container, as marketed. The upper end of the container, is normally sealed closed, by means of some form of adhesive, or heat sealing, as at 21. The sleeve 5 of this invention may be applied, by slipping concentrically around the container 17, and disposes its metal means of the susceptor 7, at a position to enhance the popping of the popcorn, or heating of any food product therein, in preparation for performance of a microwaving procedure.

In view of the above, it will be seen that the various objects and features of this invention are achieved and other advantageous results obtained. Numerous variations, within the scope of the appended claims, will be apparent to those skilled in the art in light of the foregoing description and accompanying drawings.

Having thus described the invention, what is claimed and desired to be secured by Letters Patent is:

1. A microwavable food containing package comprising a food container and food to be microwave heated contained therein, said container being made of a material transparent to microwaves, and a sleeve accessory which surrounds said container, said sleeve accessory surrounding said container being completely separate from said food container and not adhered to said food container and slidable thereon, said sleeve accessory having a microwave susceptor applied thereto to facilitate heating of the food product in said container, said food container and sleeve accessory being made from at least one-ply paper or film material, said sleeve accessory being aplied to said container after formation of the container, said sleeve accessory being in tubular form in its position surrounding said container and maintaing its position surrounding said container by friction between said sleeve accessory and said container, said sleeve accessory surrounding said container being in contiguous position thereto such that the susceptor is positioned to effectively dispose said food within the container to the maximum microwave energy to enhance microwave heating of said food product therein.

2. The package of claim 1 wherein at least one of said food container and sleeve accessory being made from a two-ply substrate, said plies of substrate being held together by a minimum of adhesive, to glue the two said plies of said substrate together.

3. The package of claim 1 wherein said sleeve is formed as a sheet which is wrapped around said container, said sheet having adhesive on one end to be put in contact with another end of said sheet to hold said sleeve accessory around said container.

* * * * *